US012129642B1

(12) United States Patent
Taybi

(10) Patent No.: US 12,129,642 B1
(45) Date of Patent: Oct. 29, 2024

(54) RAILING SYSTEM AND METHOD OF USE THEREOF

(71) Applicant: Ron Taybi, Irvine, CA (US)

(72) Inventor: Ron Taybi, Irvine, CA (US)

( * ) Notice: Subject to any disclaimer, the term of this patent is extended or adjusted under 35 U.S.C. 154(b) by 0 days.

(21) Appl. No.: 18/126,326

(22) Filed: Mar. 24, 2023

Related U.S. Application Data

(60) Provisional application No. 63/323,455, filed on Mar. 24, 2022.

(51) Int. Cl.

| | |
|---|---|
| ***E04B 1/04*** | (2006.01) |
| ***E04B 1/21*** | (2006.01) |
| *E04B 1/24* | (2006.01) |
| *E04B 1/41* | (2006.01) |

(52) U.S. Cl.
CPC ..... *E04B 1/043* (2013.01); *E04B 1/215* (2013.01); *E04B 2001/2415* (2013.01); *E04B 2001/4192* (2013.01)

(58) Field of Classification Search
CPC .. E04B 1/043; E04B 1/215; E04B 2001/2415; E04B 2001/4192; E04F 11/1812; E04F 11/181; E04F 11/1853; E04F 11/1831
USPC .. 52/704–710, 79.1, 106, 239, 282.2, 648.1, 52/837
See application file for complete search history.

(56) References Cited

U.S. PATENT DOCUMENTS

| | | | | | |
|---|---|---|---|---|---|
| 1,280,320 | A * | 10/1918 | Smith | E04B 1/4142 | 52/709 |
| RE15,979 | E * | 1/1925 | Schaefer et al. | E04B 1/4178 | 52/379 |
| 1,548,214 | A * | 8/1925 | Schaefer | E04B 1/4178 | 52/379 |
| 2,767,609 | A * | 10/1956 | Cousino | F16B 37/046 | 411/959 |
| 2,785,842 | A * | 3/1957 | Phelps | E06C 9/04 | 52/707 |
| 3,156,450 | A * | 11/1964 | Thom | E04F 11/1812 | 52/707 |
| RE28,643 | E * | 12/1975 | Blum | E04F 11/1851 | 256/59 |
| 4,054,268 | A * | 10/1977 | Sher | E04F 11/1812 | 256/67 |
| 4,690,383 | A * | 9/1987 | Batcheller | E04F 11/1853 | 256/73 |
| 5,548,939 | A * | 8/1996 | Carmical | E04B 1/4135 | 52/707 |
| 8,635,832 | B2 * | 1/2014 | Heudorfer | E04B 1/4107 | 52/704 |

(Continued)

*Primary Examiner* — Paola Agudelo
*Assistant Examiner* — Adam G Barlow
(74) *Attorney, Agent, or Firm* — Innovent Law P.C.; Karima F. Gulick

(57) ABSTRACT

A railing system coupled to a base comprising: a plurality of first railing supports and a railing. The railing support includes a bracket and at least one rebar configured to couple the bracket with the base. At least a majority of the rebar is disposed substantially horizontally in the concrete base. The railing includes a panel, a plurality of bracket couplers, and a panel coupler configured to couple the panel and the bracket coupler. The bracket coupler is configured to be at least partly inserted in the inner space of the bracket. The panel is oriented vertically next to the concrete base.

20 Claims, 13 Drawing Sheets

(56) References Cited

U.S. PATENT DOCUMENTS

| | | | | |
|---|---|---|---|---|
| 8,973,316 | B2 * | 3/2015 | Safford | E04B 2/96 52/235 |
| 10,233,630 | B1 * | 3/2019 | Francies, III | E04B 1/2608 |
| 10,385,563 | B2 * | 8/2019 | Albartus | E04B 1/4107 |
| 10,422,139 | B1 * | 9/2019 | Warmerdam | E04D 11/005 |
| 2013/0145720 | A1 * | 6/2013 | Heudorfer | E04B 1/4107 52/710 |
| 2014/0250825 | A1 * | 9/2014 | Richardson | F16B 7/187 411/81 |
| 2014/0308076 | A1 * | 10/2014 | Tabibnia | E04F 15/02452 404/99 |
| 2014/0318074 | A1 * | 10/2014 | Heudorfer | E04B 1/4107 52/710 |
| 2016/0305114 | A1 * | 10/2016 | Albartus | E04B 1/4107 |
| 2016/0305115 | A1 * | 10/2016 | Albartus | E04B 1/4107 |
| 2017/0260750 | A1 * | 9/2017 | Essig | E04F 15/02183 |
| 2018/0320365 | A1 * | 11/2018 | Albartus | E04B 1/4107 |
| 2020/0173164 | A1 * | 6/2020 | Gstach | E04C 5/00 |
| 2021/0148109 | A1 * | 5/2021 | Foley | E04B 1/043 |

* cited by examiner

RAILING SYSTEM AND METHOD OF USE THEREOF

CROSS-REFERENCE TO RELATED APPLICATIONS

This application claims priority to Provisional Patent Application U.S. Pat. No. 63/323,455 filed on Mar. 24, 2022, which is hereby incorporated by reference in their entirety.

BACKGROUND OF THE INVENTION

Field of the Invention

This invention relates to a railing system and method generally, and particularly a glass railing system coupled to a construction structure for affixing a railing system and a method of building and assembling the same.

Description of the Related Art

Modern building design for high-rise apartments and other types of building structures often have concrete balconies. These balconies allow the residents to enjoy outdoor space attached to their dwelling units or offices. For safety purposes, these balconies have railing systems installed. Typically, these guardrails are fabricated from metal, glass, wood and/or concrete. Guardrails fabricated using metal are usually either surface mounted to the top of the slab using a base plate or mounted into a core pocket. Although these designs work and provide the necessary protection, they are not the most aesthetically pleasing constructions. Metal guardrails also present obstruction to the visual field. Also, structural metal railing systems increase the amount of maintenance associated with the railing such as cleaning for debris and inspection for wear or erosion in hinges and fasteners.

Glass panel railing systems that utilize thick, glass panels as the sole vertical support are widely used as guardrails and handrails in the construction of commercial and residential building structures. These systems are typically found on elevated surfaces, acting as functional and aesthetically pleasing guardrails. Moreover, structural glass railing systems are preferred by many over other systems utilizing vertical support posts because they present much less obstruction to the visual field. Additionally, structural glass railing systems have less exposed metal in the system, which serves to lower the amount of maintenance associated with the railing.

Guard or hand railings are typically located proximate to a periphery of a balcony, deck, as a divisional barrier or along stairs. Such railings typically include a top railing and a barrier portion comprising a plurality of spindles or a barrier sheet of glass, wood or the like.

Conventional railings have several limitations. Railings constructed of metal or wood for the posts, spindles or handrails restrict the visibility of people attempting to see through them. In addition, railings of a conventional construction need to be cut to size and assembled on site to suit the particulars of the installation. The necessity to assemble the many components of a railing on location is time consuming. The widespread use of railing systems in industrial, commercial, and residential installations has led to the requirement for aesthetically pleasing structures which are readily installed at a variety of sites with a minimum of effort. Ease of installation is usually attained by fabricating as much of a railing system as is practical within the manufacturing facility, thereby minimizing the number and complexity of operations in the field. However, such procedures generally sacrifice the flexibility of tailoring the railing system on site to meet any special requirements peculiar to a particular installation. Various attempts to provide railing systems which can be built-up of standard component parts in the field to meet the needs of a particular site often become complex, ungainly, and somewhat lacking in aesthetic appeal. Some systems require special tools or special procedures which go beyond what may be available to a worker in the field having limited skills and facilities.

Other methods of setting and installing railings after a building is finished pose hazardous conditions to workers, and require additional equipment to ensure that a crew and systems/devices are on the outer side of the building allowing the crew access to the external face of the building to attach the railing system to the base of a foundation such that the glass railing or other transparent railing does not obstruct the view of a user and their enjoyment thereof.

Accordingly, there is a need for a railing system that makes use of glass panels to reduce the obstruction of view and amount of maintenance and the need for a method that allows installation of part of the railing system or railing system as a whole without the need to have a crew on the outer side of the building to attach the railing system from hazardous conditions.

There is also a need for a railing system whose components can be assembled and fabricated as much as possible before the installation on site without complex procedures.

There is yet another need for a railing system that can be tailored made for the specific requirements peculiar to a particular installation site.

SUMMARY OF THE INVENTION

The present invention relates to railing system coupled to a base comprising: a plurality of first railing supports and a railing. The railing support includes a bracket and at least one rebar configured to couple the bracket with the base. At least a majority of the rebar is disposed substantially horizontally in the concrete base. The railing includes a panel, a plurality of bracket couplers, and a panel coupler configured to couple the panel and the bracket coupler. The bracket coupler is configured to be at least partly inserted in the inner space of the bracket. The panel is oriented vertically next to the concrete base.

The railing is configured to couple with the first railing support by inserting the bracket coupler in the inner space of the bracket. The bracket coupler includes a coupler body that corresponds to an inner space of the bracket and at least one extension extending horizontally from the coupler body to be coupled with the panel and the panel coupler. The bracket further includes a slot configured to allow the extension to pass through when the coupler body is inserted in the inner space of the bracket. The bracket coupler further includes a stopper disposed on one end of the coupler body and wider than the inner space of the bracket. The stopper contacts a top portion of the bracket when the coupler body is inserted in the inner space of the bracket from above.

The panel includes at least one coupler opening for the extension of the bracket coupler to pass through. The panel coupler includes: a pair of washers coupled with the extension and located on two opposite sides of the panel respectively; and a panel cap configured to couple with an end of at least one of the extensions passing through the coupler opening of the panel. One of the washer is preferably located between the panel and the panel cap and another one of the washer is located between the panel and the body portion of the bracket coupler. In another embodiment, the panel coupler includes a plurality of panel caps each configured to couple with one of the extensions of the bracket couplers. In yet another embodiment, the panel cap has a longitudinal shape and is configured to couple with a plurality of the extensions of the bracket couplers.

The bracket includes one rebar opening configured for the rebar to pass through and couple with the bracket. In another embodiment, the rebar and the bracket are welded together.

In one embodiment, the railing system includes a second railing support disposed next to the base. The second railing support includes a flush portion disposed below the base and the support member; and an upright portion connected to the flush portion and located next to the base. The first upright portion includes a plurality of support openings each configured to fit the first railing supports. In yet another embodiment, the second railing support can include a plurality of ribs disposed between the upright portion and the flush portion.

In a different embodiment, the railing system includes a bracket groove formed on the side of the base and configured to fit one of the brackets, wherein three sides of the bracket are adjacent to the base.

In one aspect of the present disclosure, the disclosure is embodied in a method of coupling a railing system to a base including the steps of disposing one or more brackets on or adjacent to a plane or foundation/flooring, attaching the one rebar to each one of the brackets, wherein the rebars are oriented horizontally and located above the plane, and forming a base by pouring wet/unset concrete on the plane and casting the rebar into the wet concrete. The method also includes the steps of providing a railing which in turn comprises a panel, one or more bracket couplers configured to be at least partly inserted in an inner space of the bracket and then couple with the bracket, a panel coupler configured to couple the panel and the bracket coupler, and coupling the railing to the brackets so that the panel is oriented vertically next to the base.

In one embodiment, the method of installing the railing system consists of laying a base of wet and unset concrete, casting the one or more brackets into the wet concrete, where the rebars are well inside the wet and unset concrete and where the brackets are on the outer edge of base. Once the base and concrete is set and dry, attaching the rest of the railing system including the railing, the panel and the bracket coupler inside the bracket.

BRIEF DESCRIPTION OF THE DRAWINGS

It should be noted that the drawing figures may be in simplified form and might not be to precise scale.

DETAILED DESCRIPTION OF THE INVENTION

The embodiment and various other embodiments can now be better understood by turning to the following detailed description of the embodiments, which are presented as illustrated examples of the embodiment defined in the claims. It is expressly understood that the embodiment as defined by the claims may be broader than the illustrated embodiments described below. Many alterations and modifications may be made by those having ordinary skill in the art without departing from the spirit and scope of the embodiments.

Figure 1A:
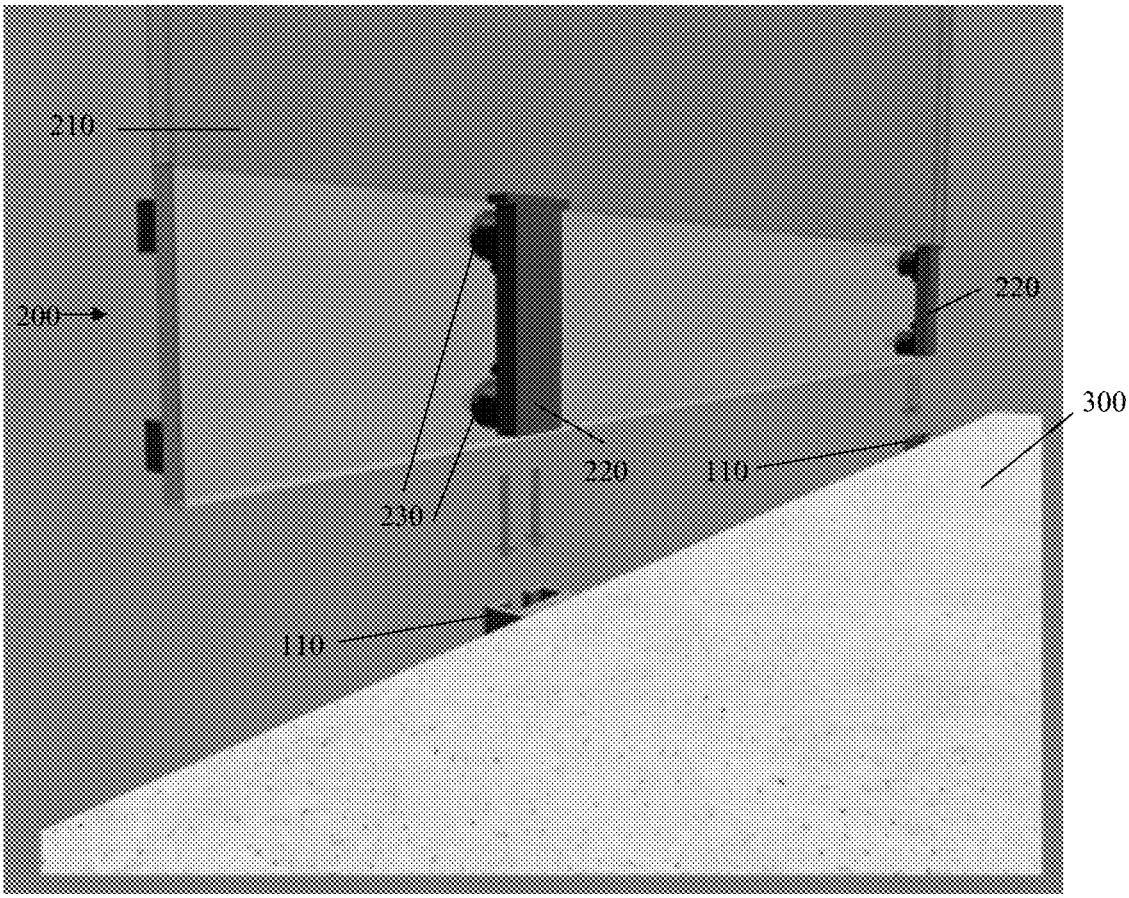
FIGS. 1A-B are perspective views of the railing system according to one embodiment of the present invention.
Figure 1B:
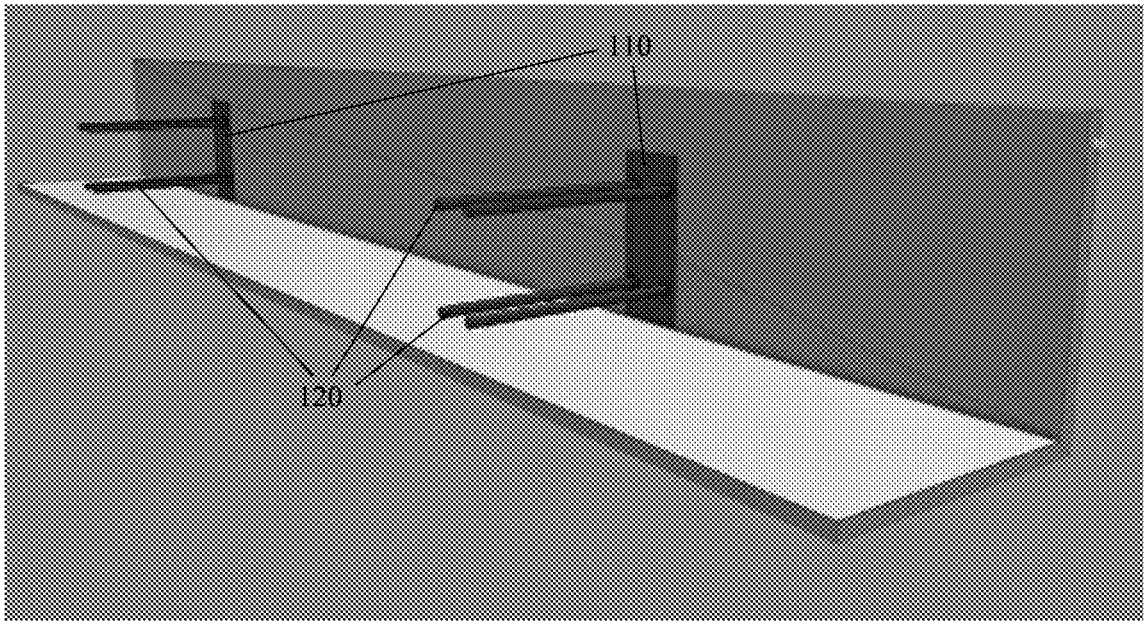

FIG. 1A is a perspective view of the railing system according to one embodiment of the present invention. The railing system is configured to be disposed next to a base 300 to provide guardrail for safety. The base 300 is preferably made of concrete but can be made of other suitable materials such as plywood, oriented strand board (OSB), high-performance panels, rammed earth, straw bales, timbercrete, hempcrete, and greencrete, The railing system includes a plurality of first railing supports 100 and a railing 200 to be coupled with the first railing supports 100. The first railing support 100 includes a bracket 110 to be attached to one side of the base 300. The first railing support 100 further includes at least one rebar 120 (not illustrated in FIG. 1A) coupled with the bracket 110, in order to attach the bracket 110 to the base 300. FIG. 1B is a perspective view of the first railing supports 100 where the base 300 is not illustrated. In the present embodiment, one end of each rebar 120 is coupled with and preferably soldered to the corresponding bracket 110. Further, the rebars 120 are oriented horizontally and disposed in the space designated for the base 300. Later, when the cements are poured on the rebars 120 to form the base 300, the rebars 120 will be embedded within the base 300 to couple the brackets 110 with one side of the base 300.

The railing 200 in FIG. 1A includes a panel 210, a plurality of bracket couplers 220 configured to couple the railing 200 with the brackets 110, and a plurality of panel couplers 230 that couples the panel 210 and bracket couplers 220 together to form the railing 200. In the present embodiment, the panel 210 is preferably made of tempered glasses and also preferably oriented vertically with respect to the base 200. However, the panel 210 can be made of acrylic and polycarb. Also, in different embodiments, the panel coupler 220 can be adjusted to tilt the panel in other angles relative to the base 300.

Figure 2:
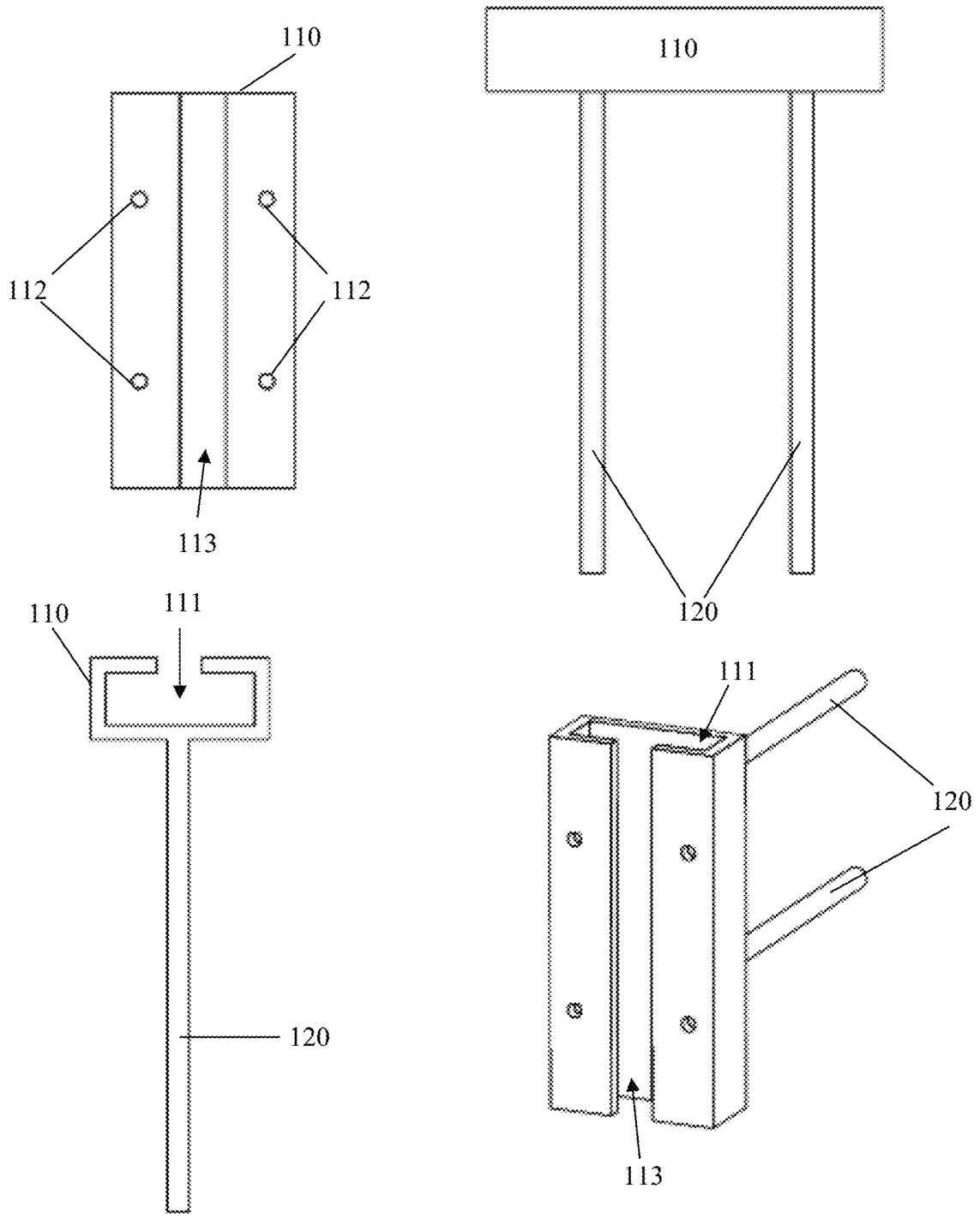
FIG. 2 illustrates various perspective views of the bracket according to one embodiment of the present invention.

FIG. 2 illustrates various perspective views of the bracket 110 of the first railing support to be attached to one side of the base 300. In the present embodiment, the bracket 110 has a C shape and encloses an inner space 111 configured to fit the bracket coupler 220 of the railing 200 illustrated in FIG. 1A. The bracket 110 includes a plurality of fastener openings 112. Once the bracket coupler 220 is inserted in the inner space 111, a plurality of fasteners 114 can be inserted in the openings 112 to then fasten the bracket 110 and bracket coupler 220 together.

Figure 3A:
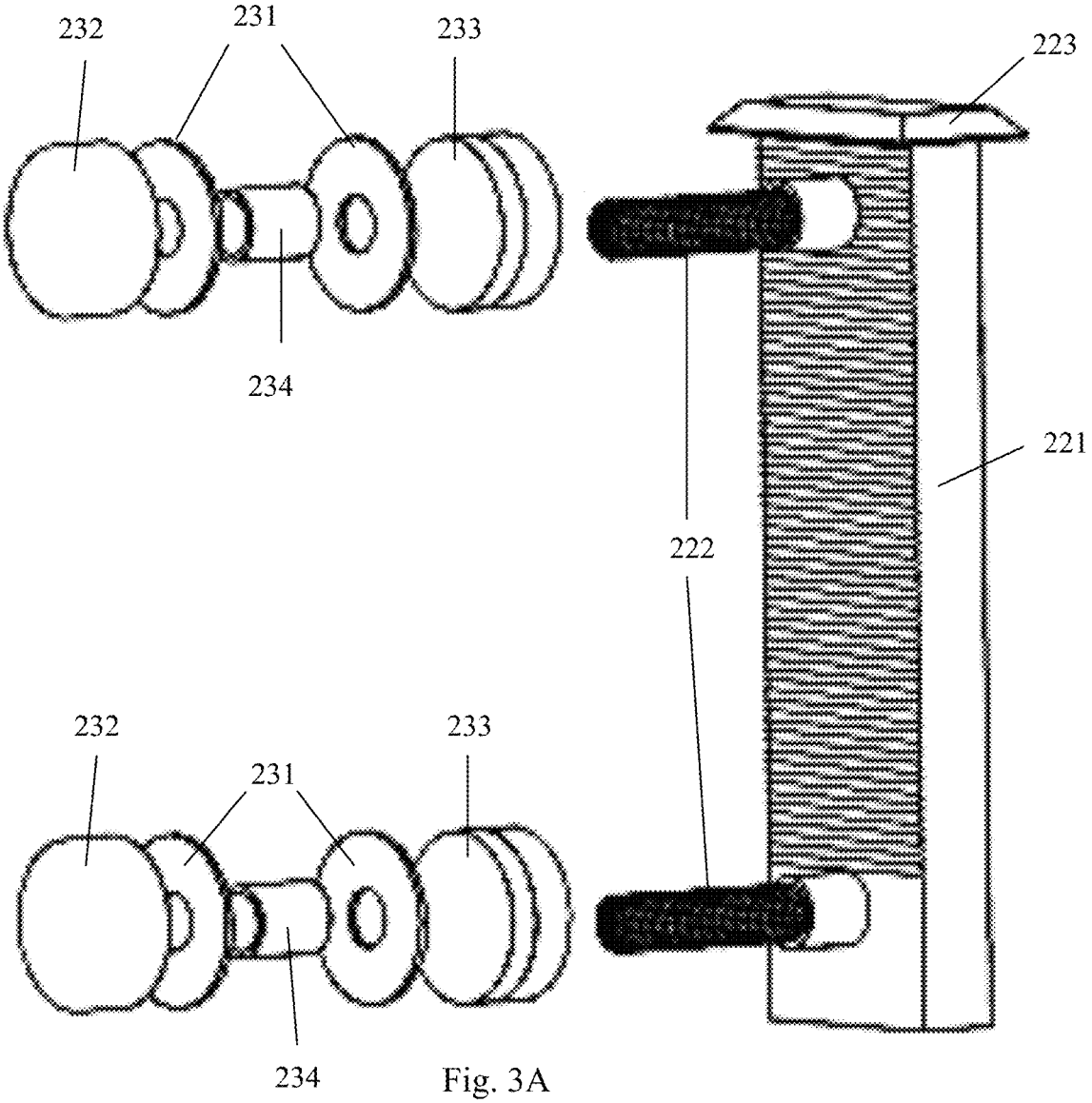
FIG. 3A illustrates perspectives views of the bracket coupler and panel coupler.
Figure 3B:
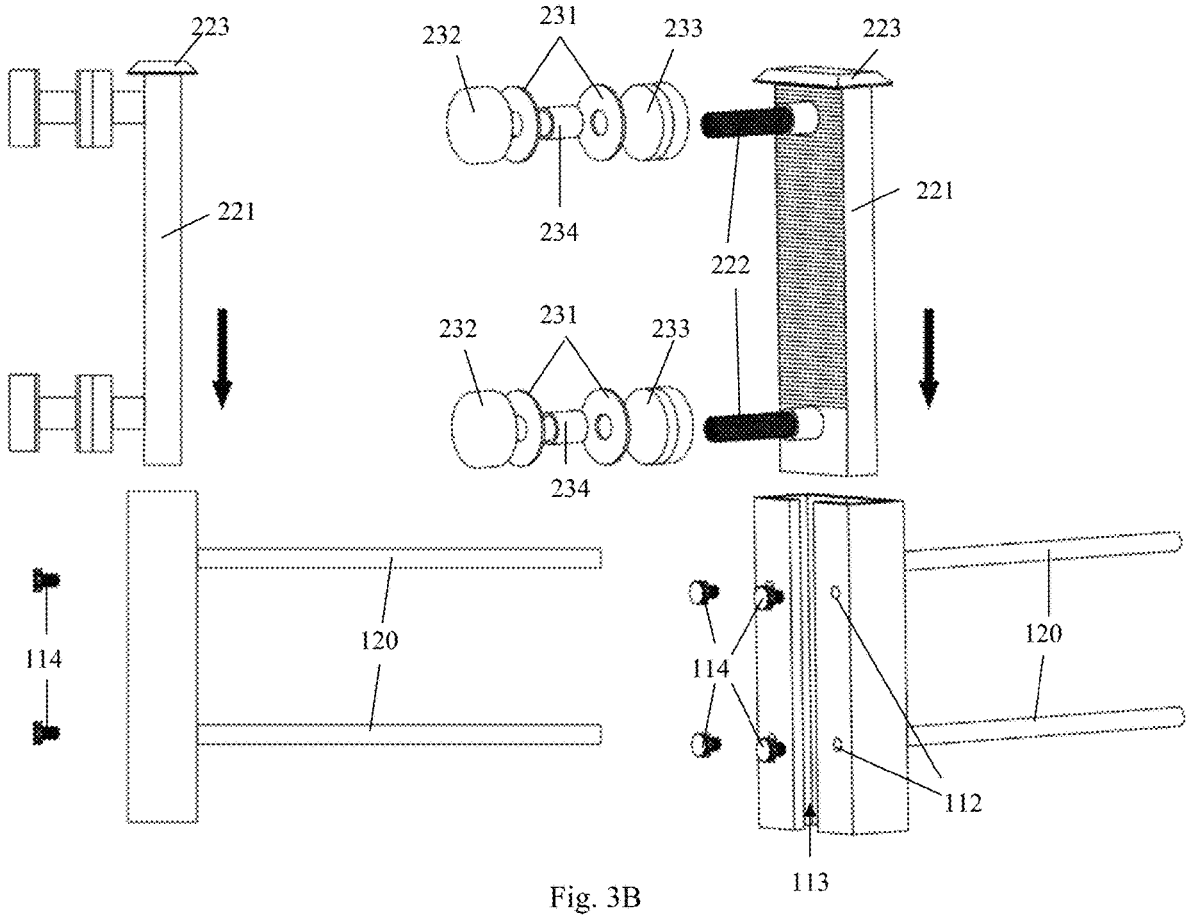
FIG. 3B illustrates perspective views of the bracket in a processing of being coupled with the bracket coupler of the railing.

FIG. 3A includes perspectives view of the bracket coupler 220 and panel coupler 230. FIG. 3B illustrates perspective views of the bracket 110 coupled with the bracket coupler 230 of the railing 200. In the present embodiment, the bracket coupler 220 includes a coupler body 221 and two extensions 222 extending horizontally from the coupler body 221. As mentioned above, the coupler body 221 is configured to be fitted in the inner space 111 enclosed by the bracket 110 so that fasteners can be used to couple the bracket 110 and bracket coupler 220 together. On the other hand, the extensions 222 are configured to pass through openings formed on the panel 210 for the panel coupler 230 to then couple the extensions 222 and the panel 210 together to form the railing 200. In the present embodiment, the bracket coupler 220 further includes a stopper portion 223 formed at one end of the coupler body 221 as a redundancy in case the fasteners fail to keep the bracket 110 and bracket coupler 220 together. The stopper portion 223 is wider than the inner space 111 of the bracket 110. The stopper portion 223 will rest on top of the bracket 110 while the coupler body 221 is inserted in the inner space 111 of the bracket coupler 220. Thus, even if the fasteners fail to secure the coupling between the bracket 110 and bracket coupler 220, the stopper portion 223 can still maintain said coupling while the fasteners are being replaced. Also, in the embodiments illustrated in FIGS. 3A-B, the fasteners can be selectively bolted or welded on the coupler body 221 through the fastener openings 112.

Figure 3C:
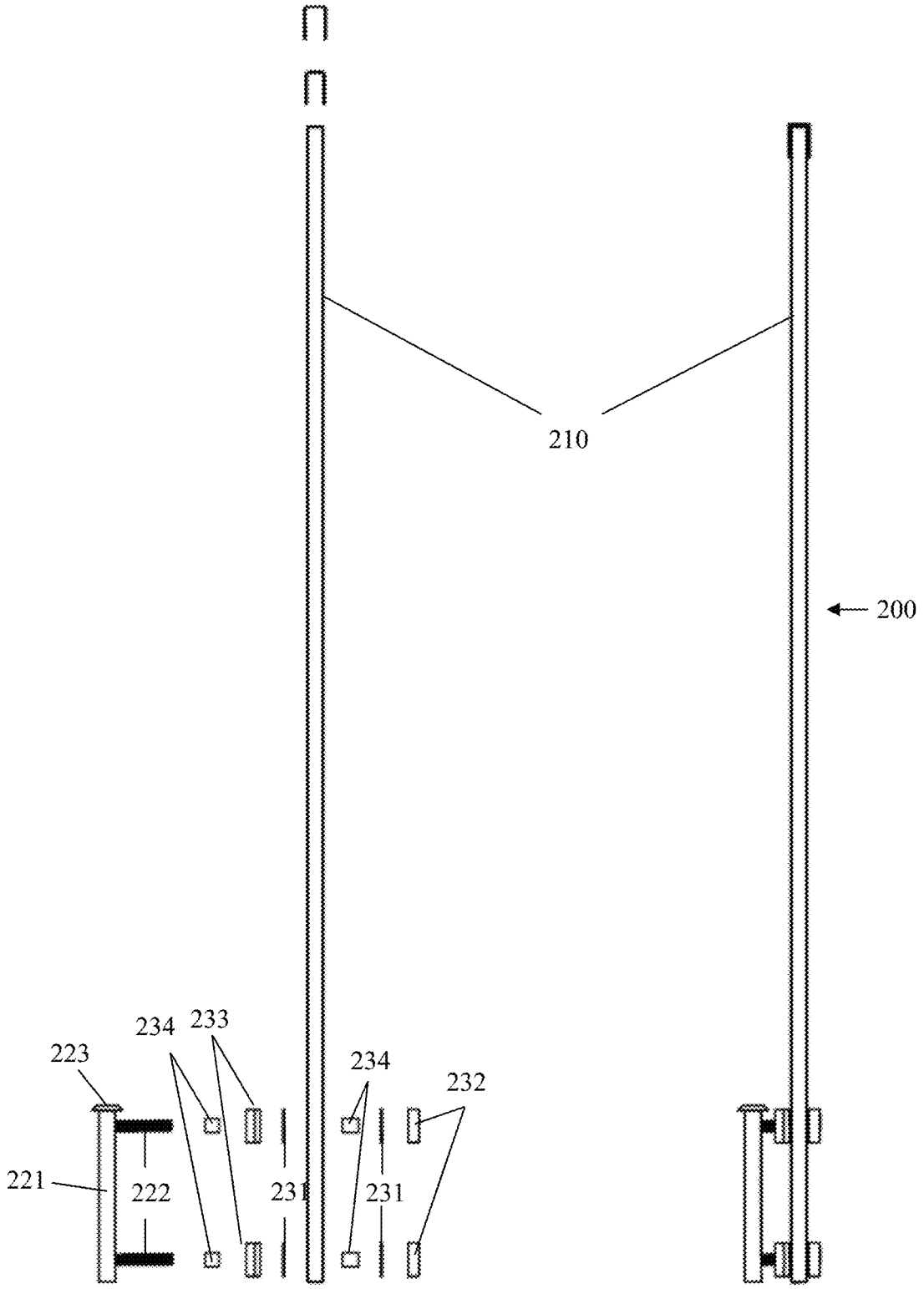
FIG. 3C illustrates the panel coupler configured to secure the panel on the extensions of the bracket to form the railing.

FIG. 3C illustrates the panel coupler 230 configured to secure the panel 210 on the extensions 221 of the bracket 220 to form the railing 200. In the present embodiment, the panel coupler 230 includes a pair of washers 231, a panel cap 232, a spacer 233, and at least one panel tube 234. Firstly, once the bracket coupler 220 is fastened to the bracket 110, the panel tube 234 is sleeved onto the extension 222 to make sure that there is no contact between the extension 222 and the panel 210. As mentioned above, the panel 210 is preferably made of tempered glasses and the panel tube 234 is used as a sleeve to prevent any contact between the preferably metal extension 222 and the panel 210 to avoid damages. The spacer 233 and one washer 231 are then put on the panel tube 234 and expose a portion of the panel tube 234 configured to be inserted in an opening on the panel 210. The panel 210 is then coupled with the bracket coupler 220 by passing the extension 222 through said opening on the panel 210, wherein a portion of the panel tube 234 is located within said opening. Another washer 231 is placed on the parts of the extension 222 and panel tube 234 that pass through the opening on the panel 210. Finally, the panel cap 232 is coupled with one end of the extension 222 to fix the panel 210 on the panel tube 234. The panel 210 is now sandwiched between a pair of washers 231 which are sandwiched between the panel cap 232 and the spacer 233.

Further, in the embodiment illustrated in FIGS. 2 and 3B, the bracket 110 includes a slot 113 formed on one side of the bracket 110 facing the panel 210. As illustrated in FIG. 3B, the bracket 110 and the railing 200 are coupled by inserting the bracket coupler 220 into the bracket 110 from above. The slot 113 allows the extension 222 to pass through as the coupler body 221 is in the process of being inserted into the inner space 111 of the bracket 110. Also, corresponding screw threads are formed on both the outer surface of the extension 222 and the inner surface of the panel cap 232. In different embodiments, the panel cap 232 can also be bolted or welded on the extension 222.

Figure 4A:
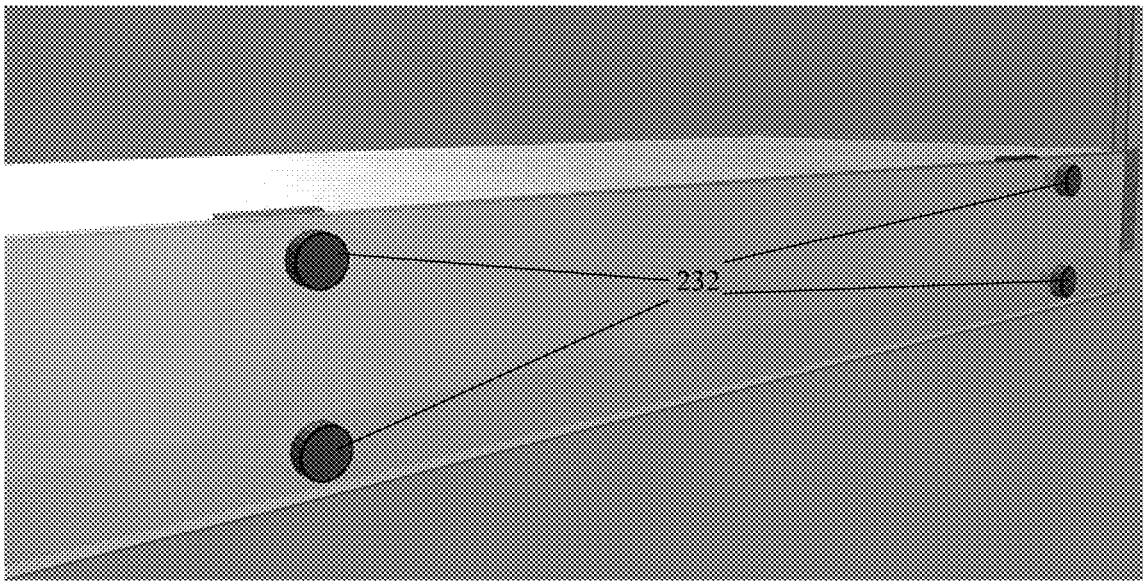
FIGS. 4A-C illustrate the implementations of three different panel caps in three embodiments of the present invention.
Figure 4B:
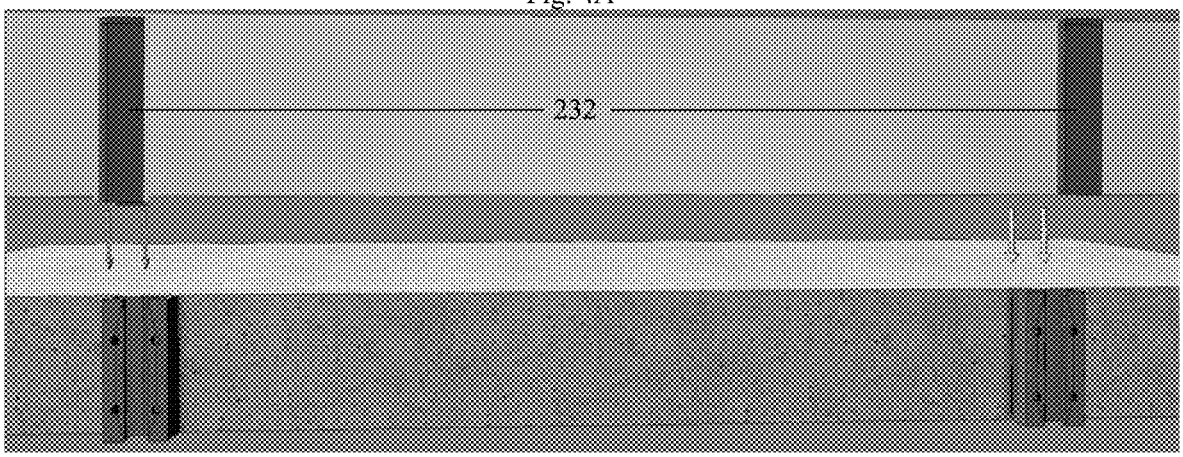
Figure 4C:
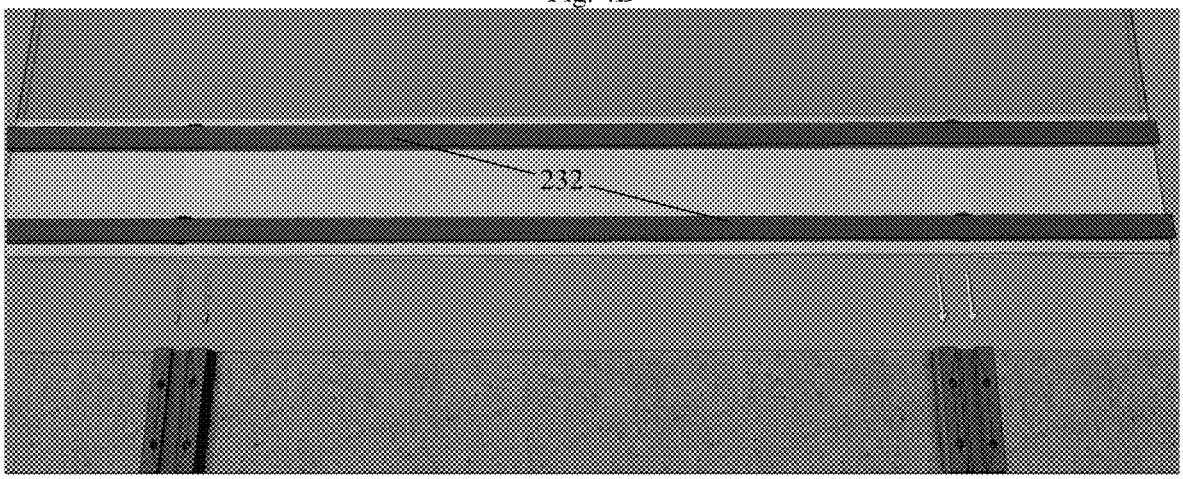

FIGS. 4A-C illustrate the implementations of three different panel caps in three embodiments of the present invention. In FIG. 4A, the railing system includes a plurality of panel caps each is configured to couple with only one of the extension. Wherein, the panel caps can be circular, rectangular, square, etc., depending on the desired aesthetics for the railing system. In the embodiments illustrated in FIGS. 4B-C, the panel cap is longitudinal and configured to couple with more than one extensions. In the embodiment in FIG. 4B, the panel cap is configured to couple with two extensions of the same bracket coupler. On the other hand, the panel cap in FIG. 4C is configured to couple with one extension of each of the bracket coupler.

Figure 5A:
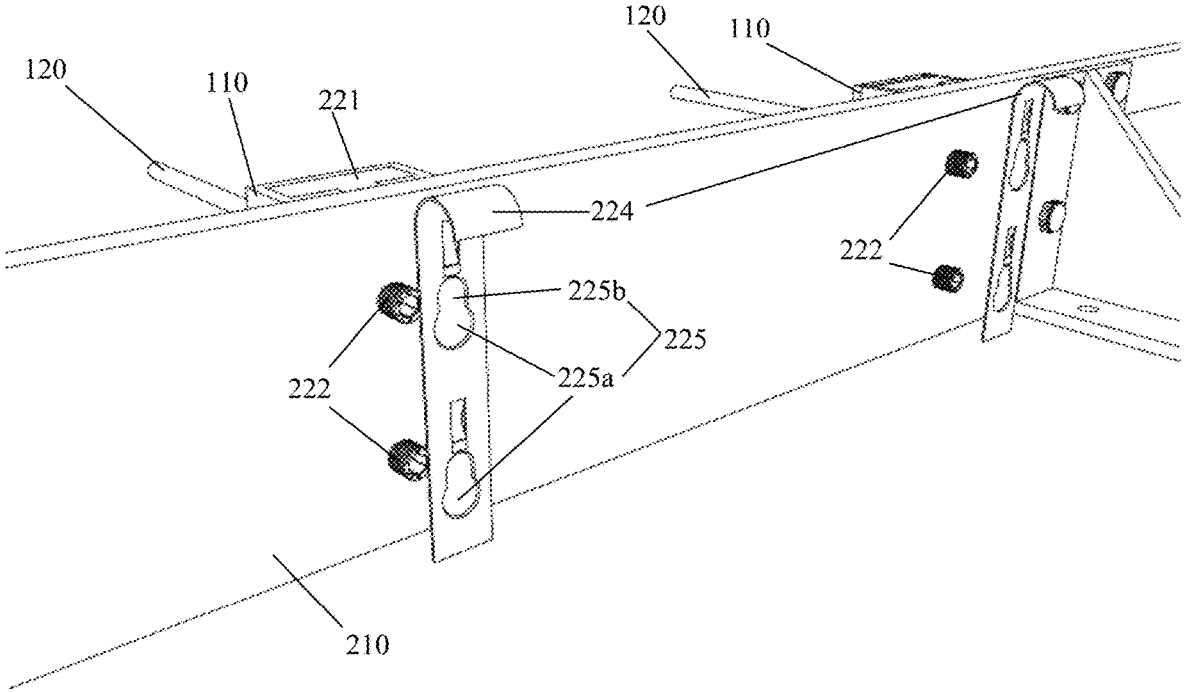
FIGS. 5A-B are perspective views of the railing system according to another embodiment of the present invention.
Figure 5B:
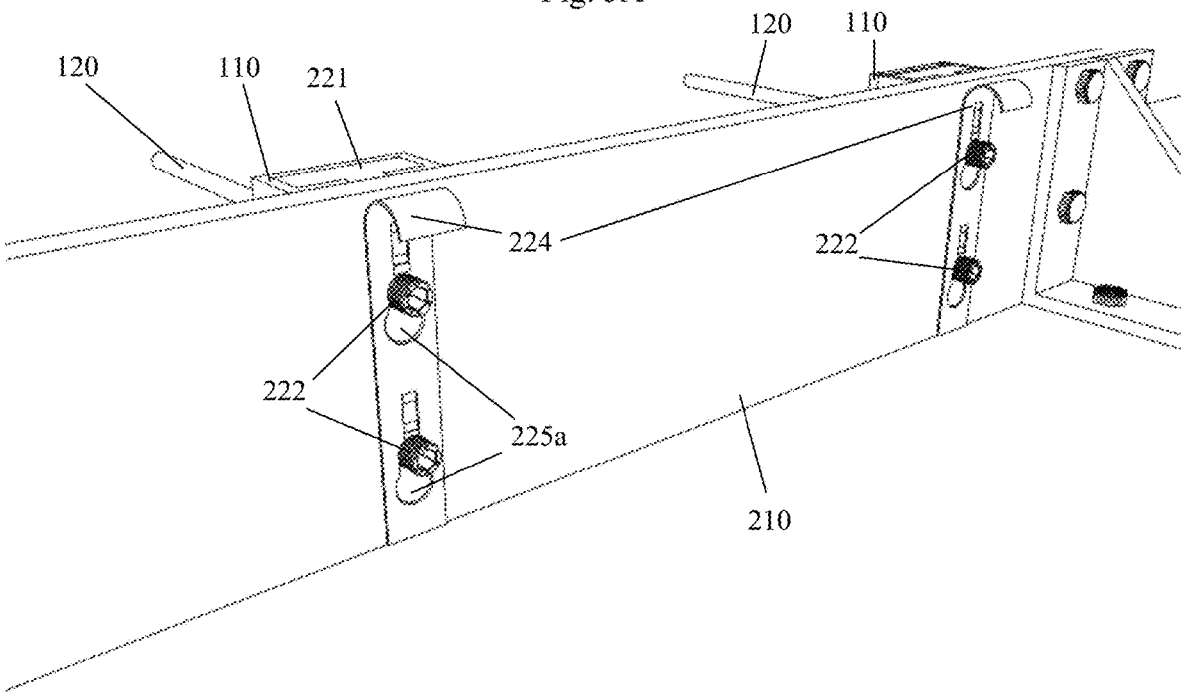
Figure 6A:
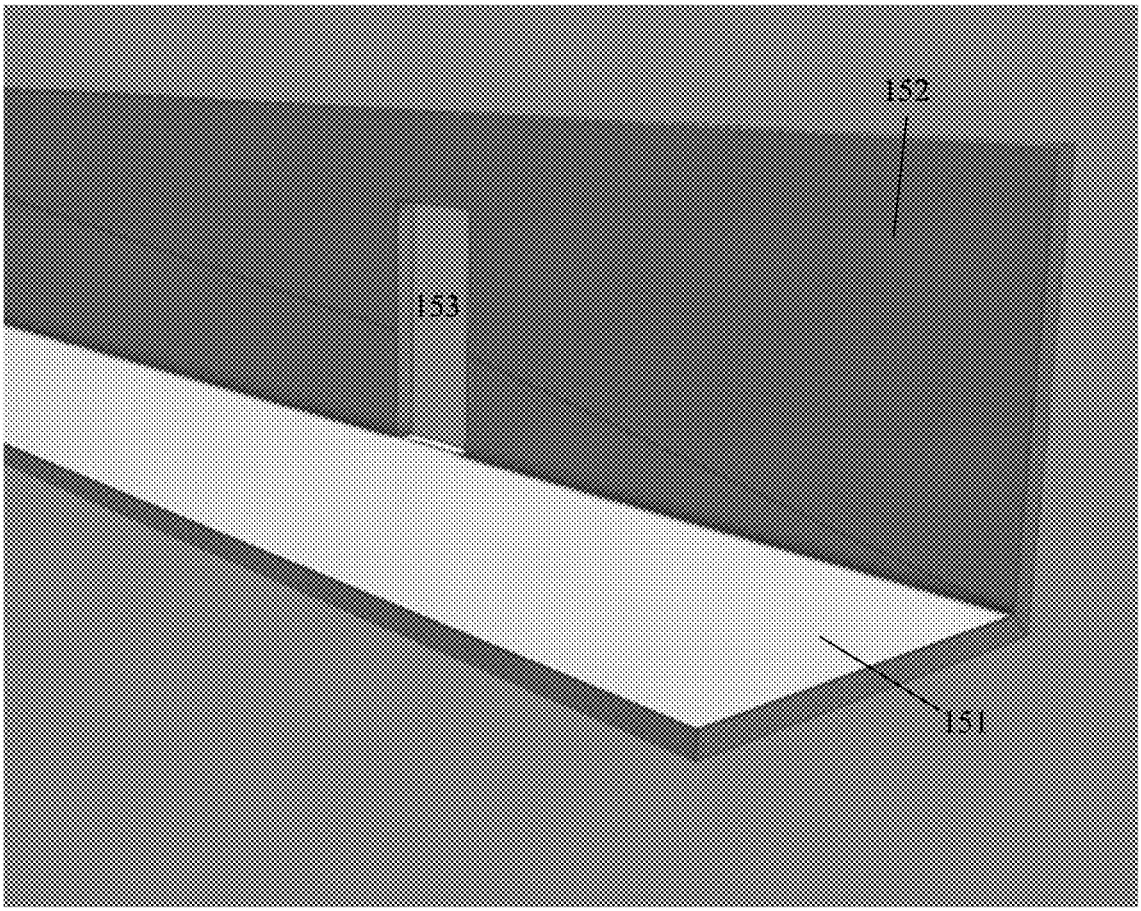
FIGS. 6A-D illustrate another embodiment of the railing system having a different railing support system.
Figure 6B:
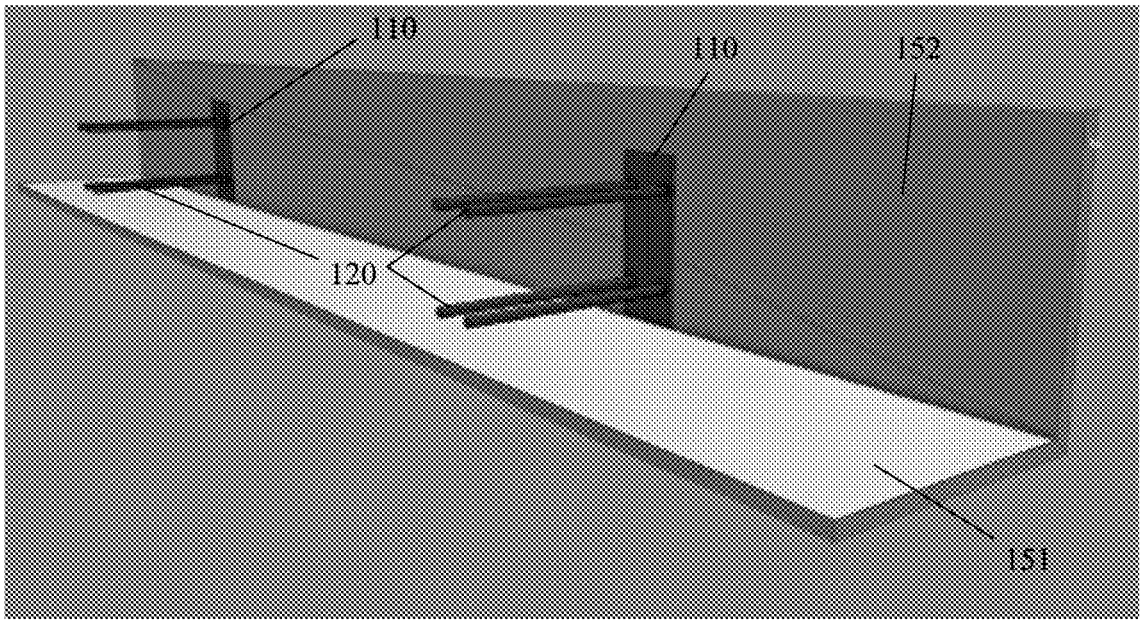
Figure 6C:
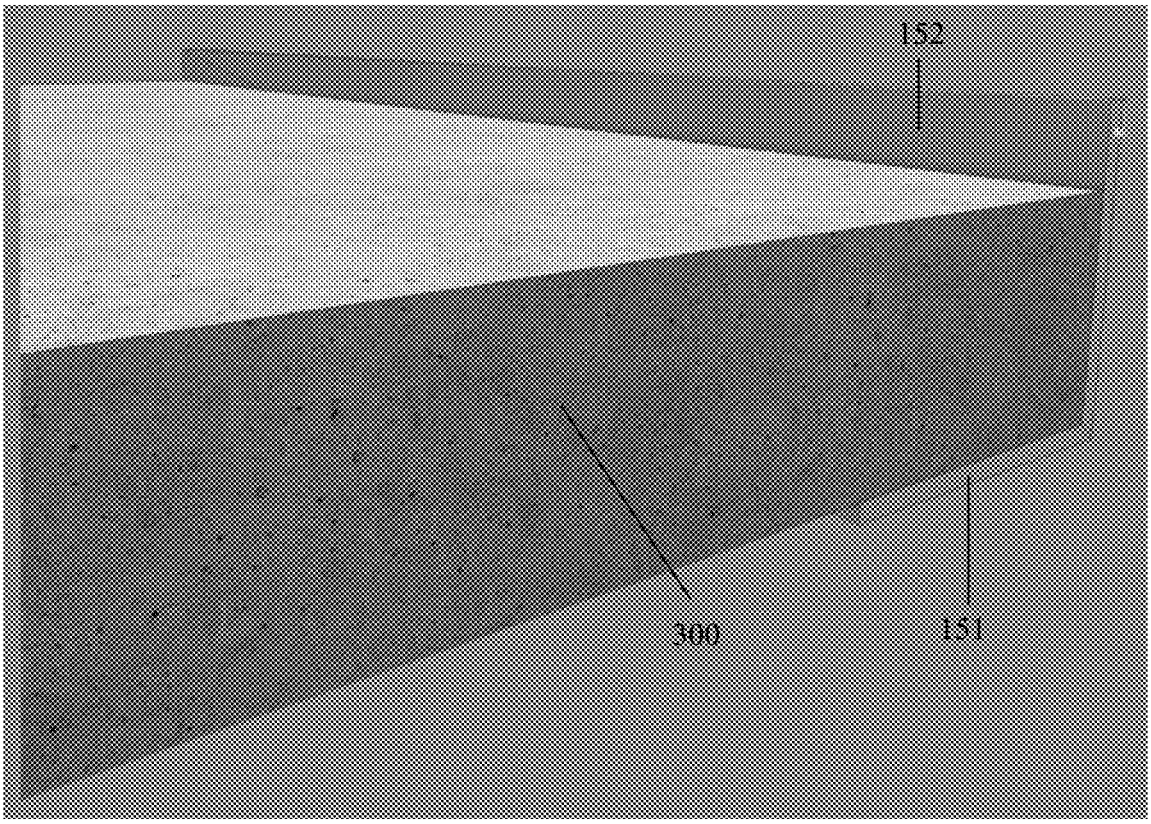
Figure 6D:
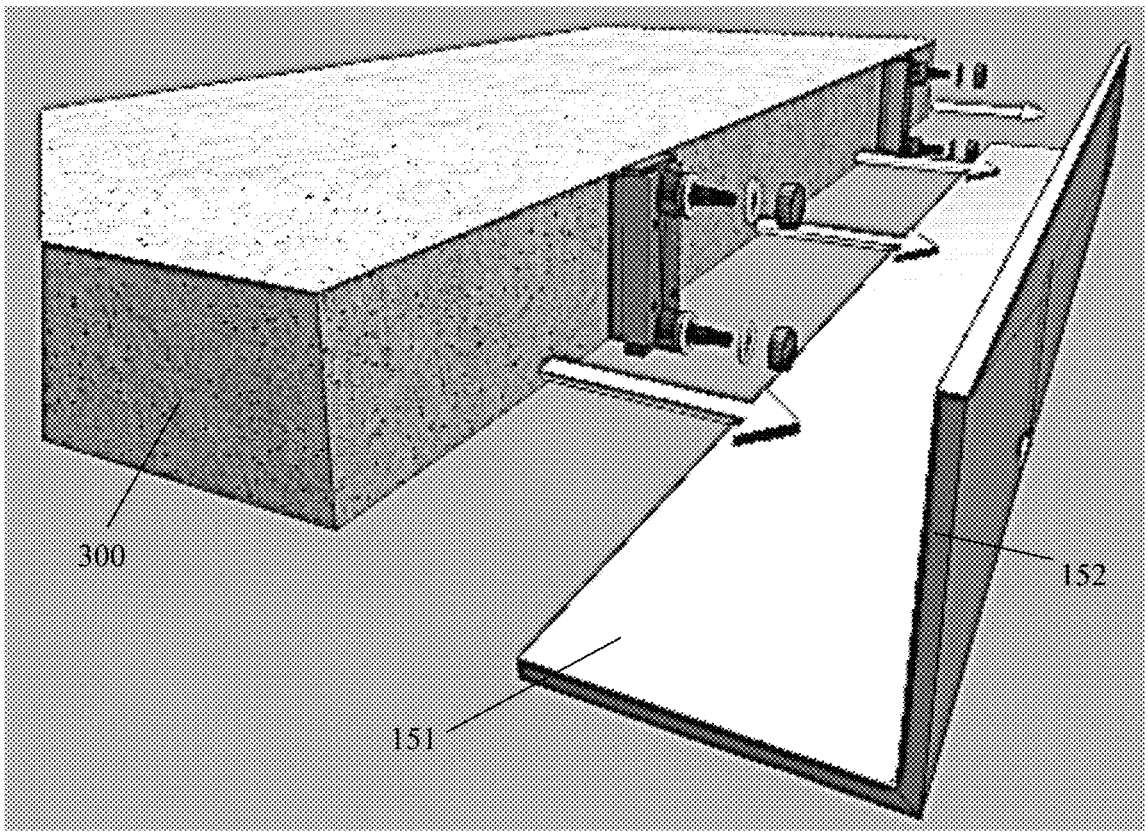

FIGS. 5A-B are perspective views of the railing system according to another embodiment of the present invention. In the present embodiment, the panel coupler is a clip 224 that directly couples with the extension 222 from the coupler body 221. The clip 224 includes two extension openings 225 each having a bigger entry section 225*a* and a smaller coupling section 225*b*. The entry section 225*a* is configured for the extension 222 to pass through after the panel 210. Then, the clip 224 is lowered so that the part of the clip 224 associated with the coupling section 225*b* can be inserted into the extension 222, to fix the panel 210 located between the bracket 110 and the clip 224.

FIGS. 6A-D illustrate another embodiment of the railing system of the present invention. The railing system further includes a second railing support to be disposed next to the base. The second railing support 150 includes a flush portion 151 and an upright portion 152. The flush portion 151 is mostly disposed below the base and the rebars. The upright portion 152 is connected to one end of the flush portion 151 and located right next to the base. Further, the upright portion 152 includes a plurality of support openings 153 each configured to have area equal to or slight bigger than that of the bracket 110. Before the implantation of the second railing support, the bracket 110 is structurally a protrusion from the base 300 as illustrated I FIG. 1A, wherein the weight of the railing 200 is shared amongst the brackets 110 and their associated rebars 120 embedded in the base 300. The second railing support is designed to share the weight of the railing 200 loaded on the brackets 110 and rebars 120. The second railing support is also a redundancy in case failure occurs in one or more of the bracket 110 and rebar 120 combinations to prevent the railing from breaking away from the base.

Figure 7A:
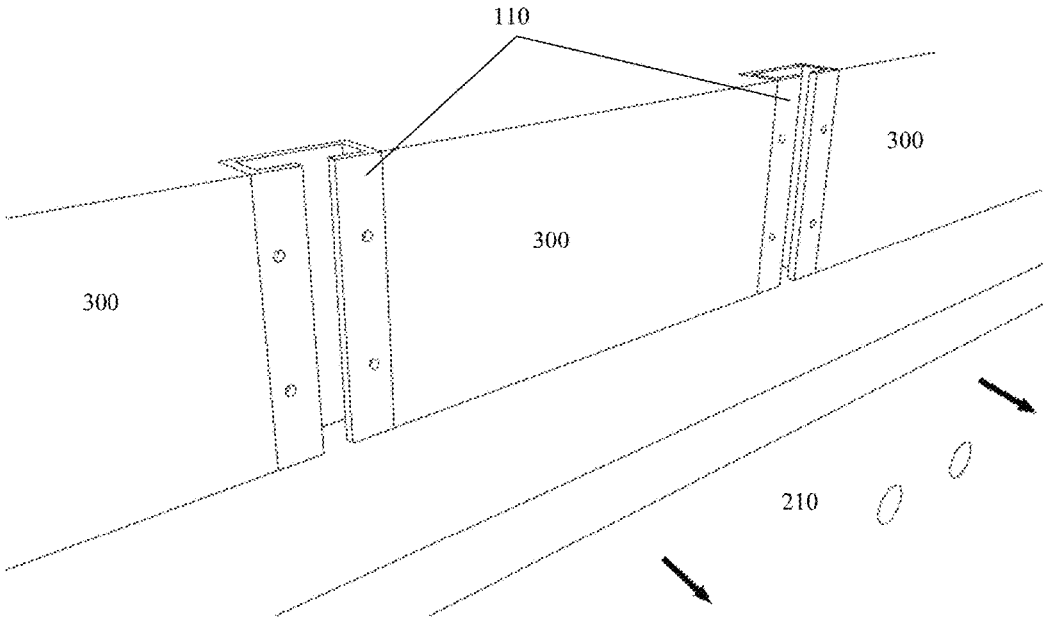
FIGS. 7A-C are perspective views the railing system in another embodiment of the present invention.
Figure 7B:
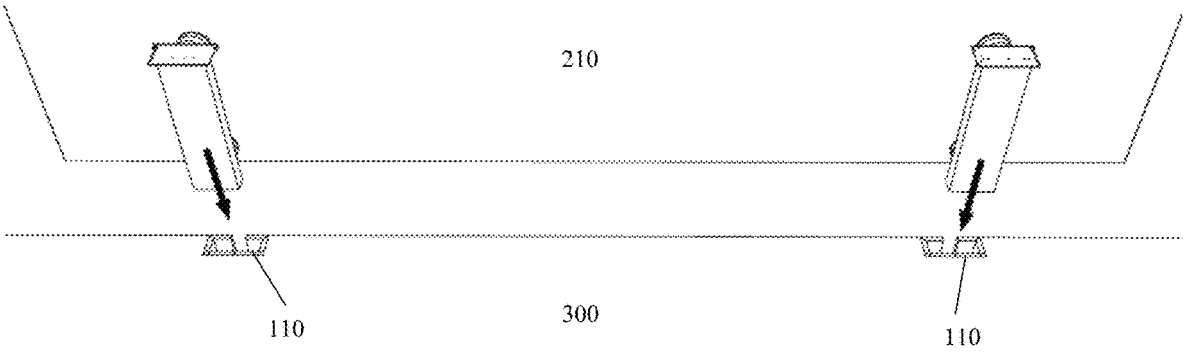
Figure 7C:
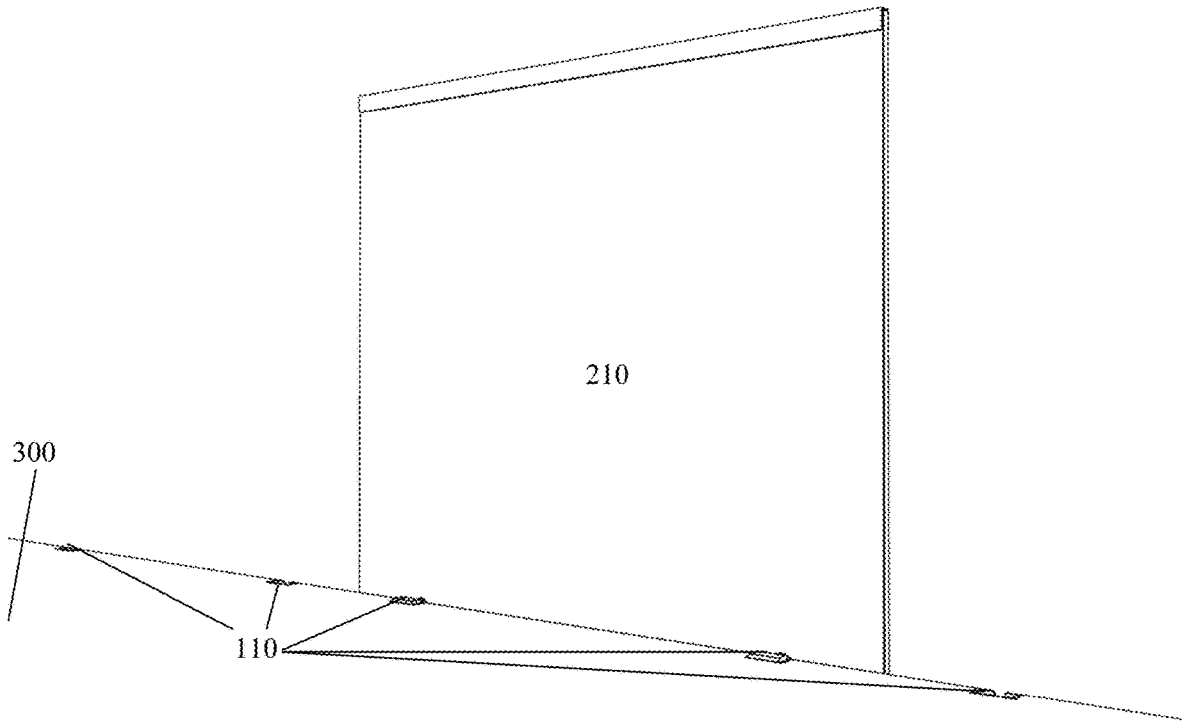

FIGS. 7A-C are perspective views the railing system in another embodiment of the present invention. As illustrated, the bracket 110 is no longer structurally a protrusion from the base 300. Accordingly, the railing 200 to be coupled with the bracket 110 will be closer to the base 300 than the ones in the previous embodiments. As illustrated in FIG. 7C, the panel 210 is right next to the base 300. Before cements are poured on the rebars to form the base, the bracket 110 is placed within the boundary of the plane. After cements are poured onto the plane to form the base 300, three of the four sides of the bracket 110 is enclosed by the base 300 except for the one to be coupled with the bracket coupler.

Figure 8:
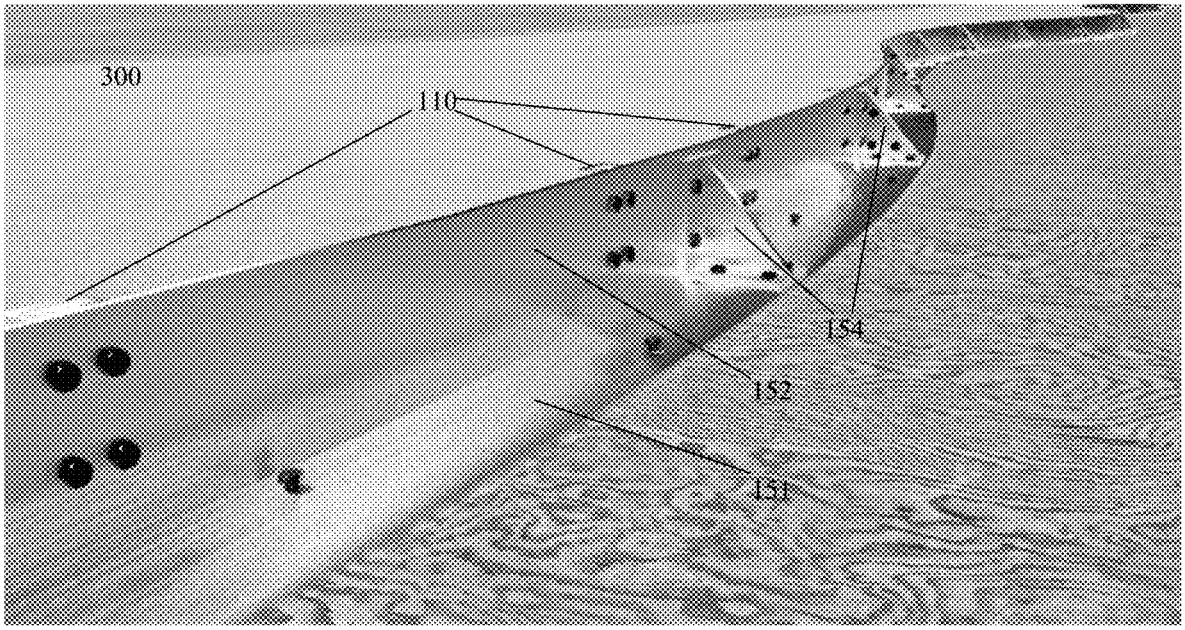
FIG. 8 illustrates another embodiment of the railing system having a different railing support system.

FIG. 8 is a perspective view of the railing system in yet another embodiment of the present invention. The railing system includes a third railing support that includes an upright portion and a flush portion. Once the railing is installed on the brackets the railing will essentially be sandwiched between the base and the third railing support. Different from the upright portion of the second railing support illustrated in FIGS. 6A-B, the upright portion of the third railing support is disposed next to the panel of the railing. More specifically, the upright portion is right next to the panel caps of the railing to support the weight of the railing. On the other hand, the flush portion of the third railing support is connected to one end of the upright portion and extends away from the base. To ensure that the upright portion can better support the weight of the railing, the third railing support includes a plurality of ribs disposed on the flush portion and connected to the upright portion.

Figure 9:
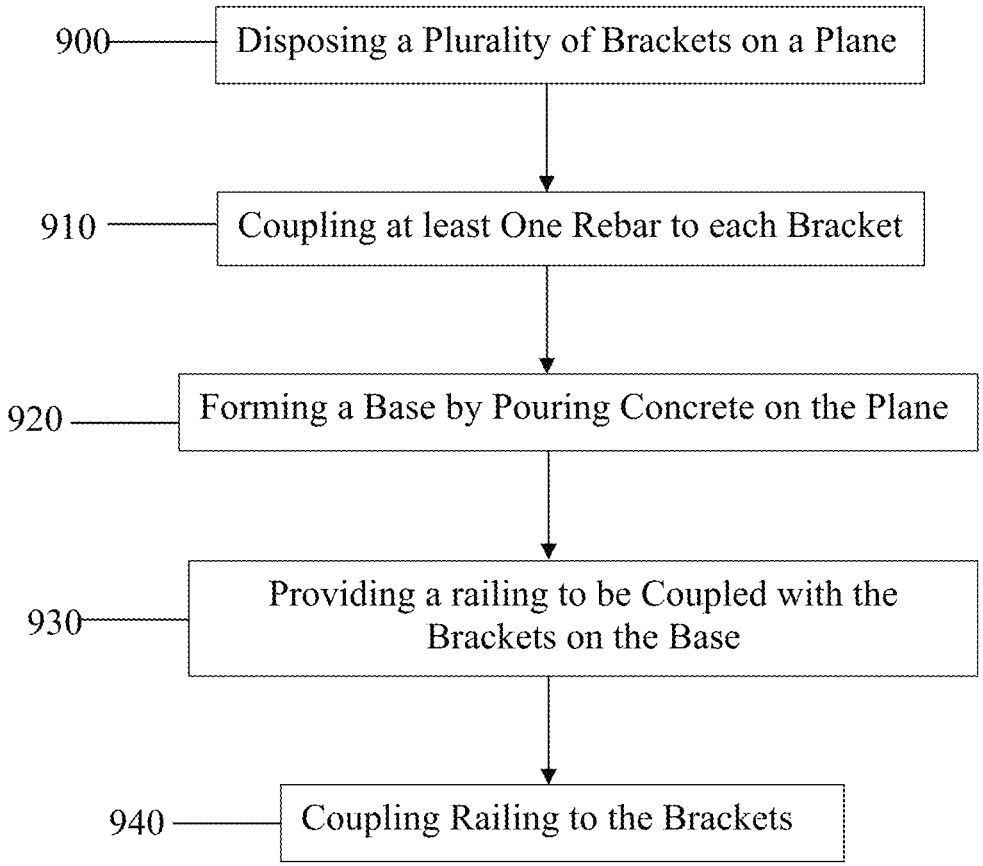
FIG. 9 is a flow chart of the method of coupling a railing system to a base according to one embodiment of the present invention.

FIG. 9 is a flow chart of the method of coupling a railing system to a base according to one embodiment of the present invention. The method includes step 900 of disposing a plurality of brackets on a plane. In the present embodiment, the plane is an area onto which cements will be poured over to form a concrete base. The plane is essentially the area covered by the base in the previous embodiments. Step 910 relates to coupling at least one rebar to each one of the brackets. The bracket each includes at least one opening for the rebar to pass through and couple with the bracket. Further, to make sure that the bracket is attached to the base after cements are poured on the plane, the rebar extends horizontally toward the center of the plane and above the plane. Step 920 relates to forming a base by pouring concrete on the plane. As mentioned above, the rebars extend from the associated brackets toward the center of the plane. Thus, once cements are poured on the plane and allowed to from a concrete base, at least a majority of the rebar is disposed substantially horizontally in the concrete base.

Step 930 involves providing a railing to be coupled with the brackets attached on the base. The railing in step 930 is substantially identical to the ones described above and illustrated in FIGS. 1A and 4A-C. Thus, the construction of the railing and its components will not be repeated here. Step 940 involves coupling the railing to the brackets. In the present embodiment, step 940 preferably involves inserting the bracket coupler, such as the one illustrated in FIG. 1A into an inner space of the bracket from above. The bracket coupler is inserted in the bracket from above is necessitated by the stopper formed on one end of the coupler body and wider than the inner space of the bracket. In different embodiments, the coupler body without a stopper can be inserted into the bracket from below. Fasteners such as bolts can be used to couple the bracket and the bracket coupler together. The bracket and bracket coupler can also be welded together during step 940.

In one aspect of the present disclosure, the disclosure is embodied in a method of coupling a railing system to a base including the steps of disposing one or more brackets on or adjacent to a plane or foundation/flooring, attaching the one rebar to each one of the brackets, wherein the rebars are oriented horizontally and located above the plane, and forming a base by pouring wet/unset concrete on the plane and casting the rebar into the wet concrete. The method also includes the steps of providing a railing which in turn comprises a panel, one or more bracket couplers configured to be at least partly inserted in an inner space of the bracket and then couple with the bracket, a panel coupler configured to couple the panel and the bracket coupler, and coupling the railing to the brackets so that the panel is oriented vertically next to the base.

In one embodiment, the method of installing the railing system consists of laying a base of wet and unset concrete, casting the one or more brackets into the wet concrete, where the rebars are well inside the wet and unset concrete and where the brackets are on the outer edge of base. Once the base and concrete is set and dry, attaching the rest of the railing system including the railing, the panel and the bracket coupler inside the bracket.

Here, the first step would be to lay a foundation or base of wet and unset concrete, such that the base has an outer perimeter. At one end of the perimeter, and the end outwardly facing an outside view (external view), cast the rebars portion of the bracket into the wet and unset concrete, allow for the concrete base to dry and set, and once the concrete base is set and dry, sliding the panel with attached bracket coupler into the complementary slot of the bracket already cast into the concrete and securing the panel with the railing system. In one embodiment, this method also includes the step of coupling the railing to the bracket includes inserting the bracket coupler in the inner space of the bracket, where the bracket coupler includes a coupler body that corresponds to an inner space of the bracket, and an extension extending horizontally from the coupler body to be coupled with the panel and the panel coupler where the bracket includes a slot configured to allow the extension to pass through when the coupler body is inserted in the inner space of the bracket.

In another embodiment, the step of coupling the railing to the bracket further includes disposing a stopper on one end of the coupler body, where the stopper is wider than the inner space of the bracket, the stopper contacts a top portion of the bracket when the coupler body is inserted in the inner space of the bracket from above. In yet another embodiment, the step of providing the railing includes forming at least one coupler opening on the panel for the extension of the bracket coupler to pass through, coupling a pair of washers with the extension and disposing the washers on two opposite sides of the panel respectively, and coupling a panel cap with at least one of the extensions passing through the coupler opening of the panel, where one of the washers is located between the panel and the panel cap and another one of the washer is located between the panel and the body portion of the bracket coupler.

In another embodiment, the method also includes the steps of coupling the panel cap with the extension which in turn includes having one or more of the panel caps each corresponds to one of the extensions of the bracket couplers, and coupling each of the panel caps with one of the extensions of the bracket couplers.

The foregoing descriptions of specific implementations have been presented for purposes of illustration and description. They are not intended to be exhaustive or to limit the invention to the precise forms disclosed, and modifications and variations are possible in view of the above teaching. The exemplary implementations were chosen and described to best explain the principles of the invention and its practical application, to thereby enable others skilled in the art to best utilize the invention and its implementations with modifications as suited to the use contemplated.

It is therefore submitted that the invention has been shown and described in the most practical and exemplary implementations. It should be recognized that departures may be made which fall within the scope of the invention. With respect to the description provided herein, it is submitted that the optimal features of the invention include variations in size, materials, shape, form, function, manner of operation, assembly, and use. All structures, functions, and relationships equivalent or essentially equivalent to those disclosed are intended to be encompassed by the invention.

The invention claimed is:

1. A railing system coupled to a base, comprising:

a first railing supports, wherein the first railing support includes:

a bracket disposed next to the base and having an inner space; and at least one rebar configured to couple the bracket with the base, wherein a length of the rebar is greater than a length of the bracket, at least a majority of the rebar is disposed substantially horizontally in the base; and a railing including:

a panel having a coupler opening; and a bracket couplers configured to be at least partly inserted in the inner space of the bracket and then couple with the bracket, wherein the bracket coupler has an extension passing through the coupler opening; and a panel coupler for coupling the panel with the bracket coupler; wherein the panel is oriented vertically next to the base.

2. The railing system of claim 1, wherein the railing is configured to couple with the first railing support by inserting the bracket coupler in the inner space of the bracket, the bracket coupler includes:

a coupler body that corresponds to an inner space of the bracket; and wherein the bracket includes a slot configured to allow the extension to pass through when the coupler body is inserted in the inner space of the bracket.

3. The railing system of claim 2, wherein the bracket coupler further includes a stopper disposed on one end of the coupler body and wider than the inner space of the bracket, the stopper contacts a top portion of the bracket when the coupler body is inserted in the inner space of the bracket from above.

4. The railing system of claim 2, wherein the panel coupler includes:

a pair of washers coupled with the extension and located on two opposite sides of the panel respectively; and a panel cap configured to couple with an end of the extensions passing through the coupler opening of the panel; wherein one of the washer is located between the panel and the panel cap and another one of the washer is located between the panel and the body portion of the bracket coupler.

5. The railing system of claim 4, wherein the panel coupler includes a panel caps configured to couple with the extensions of the bracket couplers.

6. The railing system of claim 4, wherein the panel cap has a longitudinal shape and is configured to couple with the extension of the bracket couplers.

7. The railing system of claim 1, wherein the bracket includes one rebar opening configured for the rebar to pass through and couple with the bracket.

8. The railing system of claim 1, further including a second railing support disposed next to the base, wherein the second railing support includes:

a flush portion disposed below the base and the support member; and an upright portion connected to the flush portion and located next to the base, wherein the first upright portion includes a plurality of support openings each configured to fit the first railing supports.

9. The railing system of claim 1, further including a third railing support disposed next to the base, wherein the third railing support includes:

an upright portion disposed next to the railing;

a flush portion connected to the upright portion and extending away from the base; and a plurality of ribs disposed between the upright portion and the flush portion.

10. The railing system of claim 1, further includes a bracket groove formed on the side of the base and configured to fit one of the brackets, wherein three sides of the bracket are adjacent to the base.

11. A method of coupling a railing system to a base, comprising:

disposing a brackets on or adjacent to the base;

coupling at least one rebar to each one of the brackets, wherein a length of the rebar is greater than a length of the bracket, the rebars are oriented horizontally and located in the base;

pouring concrete on the base, wherein at least a majority of the rebar is disposed substantially horizontally in the base to couple the bracket with the base;

providing a railing that includes:

a panel having a coupler opening;

a bracket couplers configured to be at least partly inserted in an inner space of the bracket and then couple with the bracket, wherein the bracket coupler has an extension passing through the coupler opening; and a panel coupler for coupling the panel with the bracket coupler; and coupling the railing to the brackets so that the panel is oriented vertically next to the base.

12. The method of claim 11, wherein the step of coupling the railing to the bracket includes inserting the bracket coupler in the inner space of the bracket; wherein the bracket coupler includes a coupler body that corresponds to an inner space of the bracket;

wherein the bracket includes a slot configured to allow the extension to pass through when the coupler body is inserted in the inner space of the bracket.

13. The method of claim 12, the step of coupling the railing to the bracket further includes disposing a stopper on one end of the coupler body, wherein the stopper is wider than the inner space of the bracket, the stopper contacts a top portion of the bracket when the coupler body is inserted in the inner space of the bracket from above.

14. The method of claim 12, the step of providing the railing includes:

forming the coupler opening on the panel for the extension of the bracket coupler to pass through;

coupling a pair of washers with the extension and disposing the washers on two opposite sides of the panel respectively; and coupling a panel cap with the extensions passing through the coupler opening of the panel; wherein one of the washer is located between the panel and the panel cap and another one of the washer is located between the panel and the body portion of the bracket coupler.

15. The method of claim 14, the step of coupling the panel cap with the extension includes:

providing the panel cap corresponding to the extensions of the bracket couplers; and coupling each of the panel caps with one of the extensions of the bracket couplers.

16. The method of claim 14, the step of coupling the panel cap with the extension includes:

providing the panel cap having a longitudinal shape and correspond to the extensions of the bracket couplers; and coupling the panel cap with the extensions of the bracket couplers.

17. The method of claim 11, further comprising disposing a second railing support next to the base wherein the second railing support includes:

a flush portion disposed below the base and the support member;

an upright portion connected to the first flush portion and located next to the base, wherein the first upright portion includes a plurality of support openings each configured to fit one of the first railing supports.

18. The method of claim 11, further comprising disposing a third railing support next to the base wherein the third railing support includes:

an upright portion disposed next to the railing;

a flush portion connected to the upright portion and extending away from the base; and at least one rib disposed between the upright portion and the flush portion.

19. The method of claim 11, wherein the base has a plurality of bracket areas corresponding to the brackets, the step of forming the base includes forming a plurality of brackets grooves on the sides of the base for accommodating the brackets, wherein three sides of the bracket are adjacent to the base.

20. A method of coupling a railing system to a base, comprising:

disposing a plurality of brackets on or adjacent to the base;

coupling at least one rebar to each one of the brackets, wherein a length of the rebar is greater than a length of the bracket, the rebars are oriented horizontally and located above in the base;

coupling the brackets with the base by pouring wet concrete on the base, wherein at least a majority of the rebar is disposed substantially horizontally in the base while the concrete is wet and unset to couple the bracket with the base;

allowing the base with coupled rebars and brackets to set and dry;

providing a railing that includes:

a panel having a coupler opening;

a bracket couplers configured to be at least partly inserted in an inner space of the bracket and then couple with the bracket, wherein the bracket coupler has an extension passing through the coupler opening; and a panel coupler for coupling the panel with the bracket coupler; and coupling the railing to the brackets so that the panel is oriented vertically next to the base.

* * * * *